US006178600B1

(12) United States Patent
French

(10) Patent No.: US 6,178,600 B1
(45) **Date of Patent: *Jan. 30, 2001**

(54) MOLDED PLASTIC SWIVEL CONNECTOR

(75) Inventor: John M. French, Boise, ID (US)

(73) Assignee: Michaels of Oregon Co.

( * ) Notice: Under 35 U.S.C. 154(b), the term of this patent shall be extended for 0 days.

This patent is subject to a terminal disclaimer.

(21) Appl. No.: 09/231,938

(22) Filed: Jan. 14, 1999

Related U.S. Application Data

(63) Continuation-in-part of application No. 09/008,213, filed on Jan. 16, 1998, now Pat. No. 5,915,939.

(51) Int. Cl.[7] ..... F41C 23/02; A44B 11/25

(52) U.S. Cl. ..... 24/2.5; 24/643; 24/656; 24/265 AL; 24/905; 42/85

(58) Field of Search ..... 24/2.5–643, 656, 24/265 AL, 905; 42/85

(56) References Cited

U.S. PATENT DOCUMENTS

| | | | | |
|---|---|---|---|---|
| 980,269 | | 1/1911 | Hunold . | |
| 2,480,662 | | 8/1949 | McKinzie | 42/85 |
| 3,061,965 | * | 11/1962 | Lewis | 42/85 |
| 4,209,157 | * | 6/1980 | Edmisten | 42/85 |
| 4,505,012 | | 3/1985 | Johnson | 24/643 |
| 4,584,858 | * | 4/1986 | Wolter | 24/643 |
| 5,018,652 | | 5/1991 | Holtzclaw, Jr. | 224/150 |
| 5,067,267 | | 11/1991 | Ives | 42/85 |
| 5,074,069 | | 12/1991 | Shire | 42/85 |
| 5,148,582 | | 9/1992 | Dennis, Jr. | 24/625 |
| 5,325,618 | | 7/1994 | Turner | 42/85 |
| 5,440,787 | | 8/1995 | Figueroa et al. | 24/50 |
| 5,642,584 | | 7/1997 | Riggenbach | 42/85 |
| 5,669,118 | * | 9/1997 | Frano et al. | 24/265 AL |
| 5,692,654 | * | 12/1997 | Bell | 24/2.5 |
| 5,802,756 | | 9/1998 | Hightower | 42/85 |

* cited by examiner

*Primary Examiner*—Victor N. Sakran
(74) *Attorney, Agent, or Firm*—Chernoff, Vilhauer, McClung & Stenzel, LLP

(57) ABSTRACT

A sling system for attachment to a firearm using conventional sling-mounting studs, or for attachment to luggage, and including a molded plastic connector portion attached to a strap portion. The strap portion may be of tubular cloth enclosing a padding element that is adhesively attached to the interior of the tubular cloth portion. The connector portion of the sling includes a pair of legs each defining one of a pair of collinear bores to receive a swivel pin extending between the legs to attach the connector to an article to be carried.

16 Claims, 6 Drawing Sheets

MOLDED PLASTIC SWIVEL CONNECTOR

This is a continuation-in-part of U.S. patent application Ser. No. 09/008,213, filed Jan. 16, 1998, now U.S. Pat. No. 5,915,939.

BACKGROUND OF THE INVENTION

The present invention relates to a connector for slings for carrying things, and in particular to a connector for use in fastening a firearm sling to a sling swivel.

Elongate carrying straps have long been used to carry rifles and shotguns and various articles of luggage. Such carrying straps or slings have previously been made of leather or heavy cloth webbing attached by the use of various hooks or buckles providing for adjustment of length in use. In attaching such slings to firearms, end portions of the straps have been extended and doubled back through loops, usually of metal, that are mounted on a firearm so that the loop is free to swivel about an axis usually extending transversely with respect to the length of the firearm and parallel with the width of the sling strap. Usually such loops, known as sling swivels, are mounted on a head of a sling mounting stud attached to a stock portion of a firearm, and are free to swivel with respect to it. Sling swivels are shown, for example, in U.S. Pat. Nos. 4,505,012 and 5,067,267.

Various connectors have been used to connect the flexible strap or sling to the sling swivel. Such connectors have been made from metal or plastic. The connectors must securely fasten the strap to the sling swivel to prevent firearms from slipping or falling and accidentally discharging. Metal connectors in the past have been somewhat costly, and yet some of such connectors have not been particularly easy to use. Others have not securely fastened the sling to the sling swivel. Connectors made of metal have in some cases been undesirably noisy. Connectors made of other materials such as high strength plastics have been quieter and less costly to make, but have been thought by some not to be strong or secure enough, or have had a bulky appearance thought by some not to be pleasing.

What is therefore desired is a connector for fastening a sling to a firearm sling swivel or to other loads that securely fastens the sling to the article, is easy to use, is quiet in use, and provides a pleasing appearance.

SUMMARY OF THE INVENTION

The present invention supplies an answer to the aforesaid need and overcomes the disadvantages of the prior art mentioned above, by providing an improved connector for use in fastening a flexible strap to a sling mounting member. The connector includes a body attachable to the flexible strap. First and second legs extend from the body, the legs being spaced apart from each other. The first and second legs each define one of a pair of collinear bores, and the body defines a groove in communication with the bore of the first leg. The connector further includes a swivel pin having an arm. The swivel pin is mountable to extend between the first and second legs and has front and rear end portions receivable within respective ones of the pair of collinear bores. The arm is receivable within the groove. The body is capable of securing the arm within the groove.

In another embodiment of the invention a flexible elongate sling member is attached to such a connector to form a sling for carrying an object.

The foregoing and other objectives, features, and advantages of the invention will be more readily understood upon consideration of the following detailed description of the invention, taken in conjunction with the accompanying drawings.

DETAILED DESCRIPTION OF THE PREFERRED EMBODIMENTS

Figures 1, 2, 3, 4, 5:
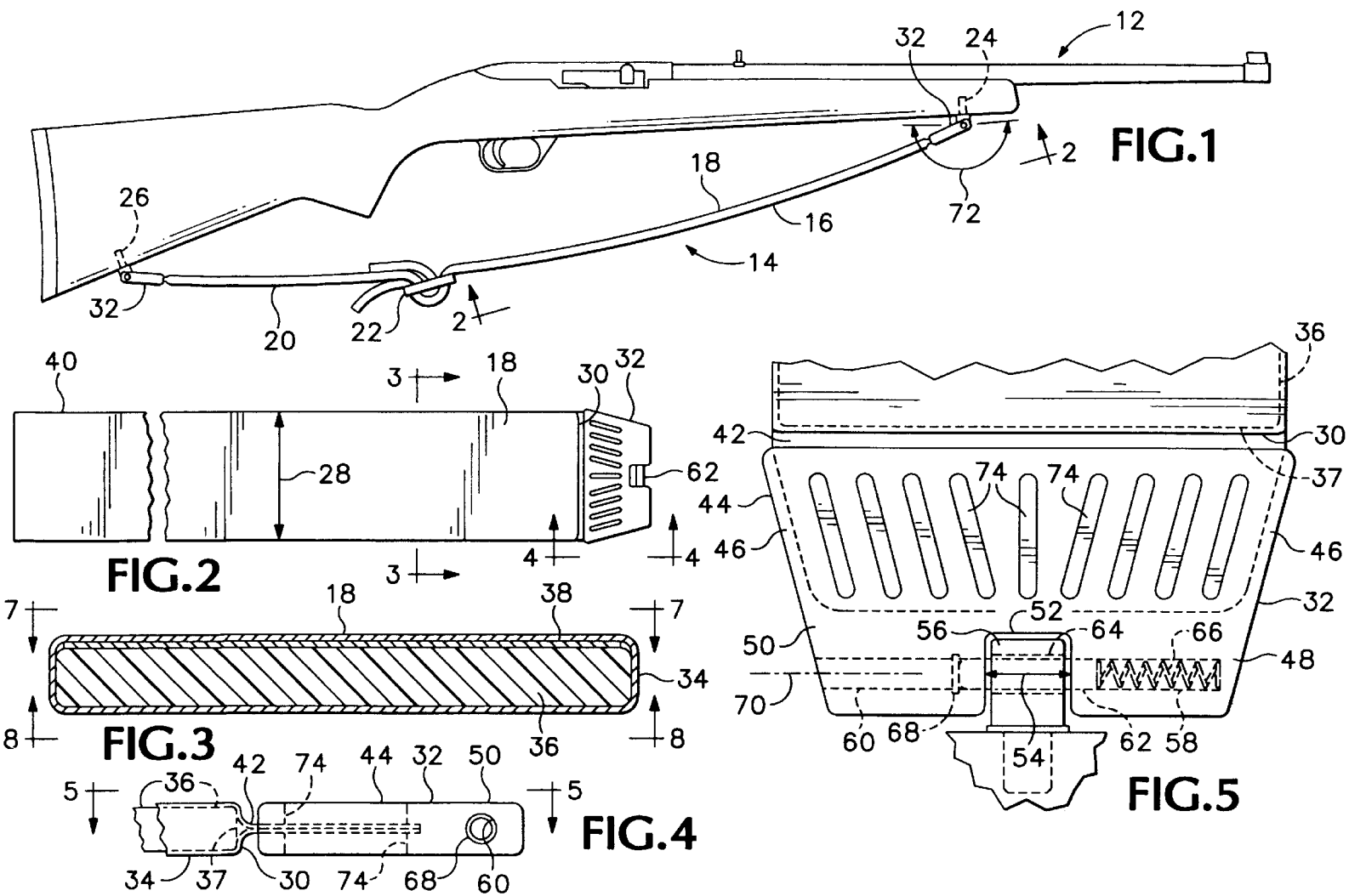
FIG. 1 is a side elevational view of a rifle equipped with a sling which is an embodiment of the present invention.
FIG. 2 is a view of a forward portion of the body of the sling shown in FIG. 1, taken in the direction indicated by the line 2—2.
FIG. 3 is a section view of the portion of the sling shown in FIG. 2, taken along the line 3—3, at an enlarged scale.
FIG. 4 is a view of a portion of the sling shown in FIG. 2, taken along the line 4—4, at an enlarged scale.
FIG. 5 is a view taken along line 5—5 of FIG. 4 of the portion of a sling shown in FIG. 4, together with a sling swivel base.

Referring now to the drawings, in FIG. 1 a rifle 12 is shown equipped with a sling 14 embodying the present invention. The sling 14 has an elongate sling body 16 including a flexible, elongate, forward sling body member 18 and a flexible elongate, rearward sling body member 20 interconnected with each other adjustably by a buckle 22, so that the overall length of the sling 14, between a pair of sling mounting studs 24 and 26, is adjustable.

As shown in FIG. 2, the elongate forward sling body member 18 has the general characteristics of a padded strap having a comfortable width 28. At an outer end 30 of the elongate sling body member 18 is a connector 32 of a molded plastics material attached to the outer end 30 by being molded in place, as by injection molding of suitable thermoplastic material directly onto and around a part of the material of which the forward sling body member 18 is made.

The forward sling body member 18 may be made, for example, of a tubular outer portion or sleeve 34 of cloth material as shown in FIG. 3, with a generally rectangular padding element 36 made of material such as a suitable synthetic plastic foam material located within the tubular cloth outer portion or sleeve 34, and preferably held securely in the desired position within the tubular cloth sleeve as by use of a layer 38 of an adhesive material. At an inner end 40 of the body member 18, the padding element 36 is not present and the tubular cloth sleeve 34 may be collapsed to a smaller thickness to be fastened by the buckle 22 as shown in FIG. 1.

The padding element 36 has an end 37 a small distance away from the extreme end of the tubular cloth sleeve 34, as may be seen best in FIGS. 4 and 5. The tubular cloth sleeve 34 is flattened, as shown at 42, and extends within the body portion 44 of the connector 32, which is molded around an end portion of the tubular cloth sleeve 34. As shown in FIG. 5, the margin portions 46 of the tubular cloth sleeve 34 may be trimmed to fit within a tapered shape of the body 44 as seen in plan view, that is, as seen from the inside or outside of the sling 14 in its usual position attached to the rifle 12.

The body 44 of the connector 32 extends further away from the strap-like body member 18 of the sling 14 and defines a pair of legs 48 and 50. A U-shaped opening or space 52 defined between the legs 48 and 50 has a width 54 great enough to receive a swivel base, such as the head 56 of a swivel mounting stud 26. A first bore 58 is defined within the leg 48 and a second bore 60 is defined within the leg 50. The two bores 58 and 60 are collinear with each other and large enough to receive a swivel pin 62 that extends through a corresponding bore 64 defined within the head 56 of the swivel-receiving stud 24 or 26. The opposite ends of the swivel pin 62 are located, respectively, in the bores 58 and 60.

Figure 6:
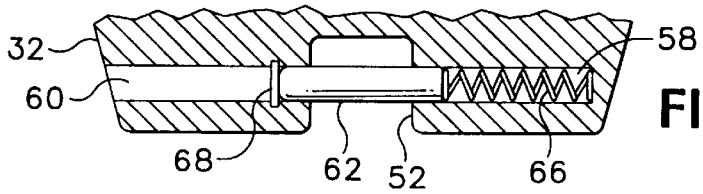
FIG. 6 is a view similar to that of a portion of FIG. 5, but cut away and showing a swivel portion of a connector portion of the sling shown in FIGS. 2–5.

A spring 66, for example, a small helical compression spring, is located within the bore 58 and pushes against the end of the swivel pin 62, urging the swivel pin 62 out of the bore 58 and toward the bore 60, as may best be seen in FIG. 6. A retainer 68, such as a small resiliently expanding ring, is located within the bore 60, engaged with the interior wall thereof, and retains the swivel pin 62 within the bores 58 and 60 extending across the space 52 between the legs 48 and 50 through the bore 64. The swivel pin 62 thus keeps the connector 32 attached to the head 56 of the swivel stud 24 or 26, or to another swivel base, and allows the connector 32 to pivot about swivel axis 70 defined by the swivel pin 62, through an angle 72 as shown in FIG. 1, for example, depending on how much slack is available in the sling 14.

The elongate body 16 of the sling is more or less flexible, depending upon the material of which the forward and rearward sling body members 18 and 20 are formed. Such materials may include the tubular cloth sleeve 34 and the padding element 36, or, instead, may be a simple heavy woven webbing, or other specially-made flexible materials of suitable strength, or even a suitable leather strap.

The body 44 of the connector 32 is permanently fastened to the outer end 30 of the sling body member 18 or 20 by being formed in place on and surrounding the outer end portion 30, preferably by forcing suitable molten thermoplastic material into an injection mold under suitably high pressure to force the plastic material into intimate contact with the outer end portion 30 of the sling body member 18 or 20. As the molded thermoplastic material cools it adheres to and becomes intimately attached to the outer end portion 30, and depending on the materials used, may be thermally welded to the surfaces of the outer end portion 30.

To ensure that the molding process accomplishes such attachment, the mold preferably includes clamping ridges or bars which grip the outer end portion 30 of the elongate sling body member tightly, so that the pressure used to inject the thermoplastic material forces the thermoplastic material into contact with the surfaces of the outer end portion 30 but does not force the outer end portion 30 out of the area where the thermoplastic material is being molded in place about the outer end portion 30. Such clamping ridges in contact with the outer end portion 30 leave a number of openings 74 defined through the body portion 44, exposing the surfaces of the outer end 30 between portions 76 of the molded plastic body 44 of the connector 32. While suitable plastics materials of various types may be utilized for the connector 32, it will be understood that a certain degree of strength and rigidity will be necessary, as well as the ability to withstand the temperatures likely to be encountered as a result of heat radiated from a firearm equipped with a sling 14 according to the present invention. Accordingly, it has been found that a material such as a polypropylene plastic resin sold under the trade name MULTIBASE G44D24 available from the Multibase Company, of Grenoble, France, having a Shore D hardness of 44, will serve satisfactorily as the material of the connector 32.

It will be understood that a suitable plastic resin might be injected in a liquid form at a relatively low temperature, with a catalyst added during injection so that the material hardens to the required amount by a process of reaction-setting in place about the outer end portion 30.

Figure 7:
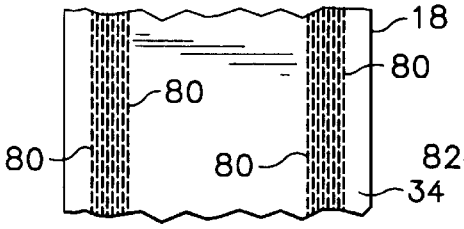
FIG. 7 is a view taken in the direction of line 7—7 of FIG. 3, at an enlarged scale, showing a portion of the body of the sling shown in FIG. 2.
Figure 8:
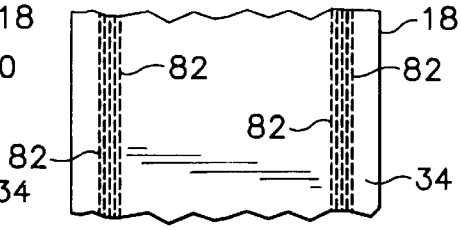
FIG. 8 is a view taken in the direction of line 8—8 of FIG. 3, at an enlarged scale, showing a portion of the body of the sling shown in FIG. 2.

The material for the sling body members 18 and 20 also must be chosen to be durable enough for the intended purpose, and it has been found that a woven tubular material of heavy polypropylene threads forming a cloth of at least about 800 denier, such as that available from Janisset, of Monistrol-Sur-Loire, France as its tubular webbing, is suitable. Consideration must be given to the temperatures at which the plastic and the cloth melt. Preferably, such a tubular material will also include several parallel threads or small strips 80 of rubber-like non-slip material, as shown in FIG. 7, extending longitudinally of the tubular cloth sleeve 34 so as to be located on the inner side of the sling 14. That is, the threads 80 should be on the side of the sling 14 facing toward the stock of a rifle 12 equipped with such a sling, to make the sling 14 less likely to slip off the user's shoulder.

Additionally, it may be desirable to include threads such as parallel threads 82 of a contrasting color or of a reflective material, woven into the opposite side of the tubular cloth sleeve 34, either for decorative purposes, or to provide a measure of safety through high visibility reflectiveness. It will be understood that the sling 14 may be used to carry objects other than military rifles and that in certain cases it may be highly desirable to have such high visibility as may be provided by the inclusion of the reflective threads 82 in such a sling 14. The threads 82 could be of reflective stripe material available from the Minnesota Mining & Mfg. Co. of Minneapolis, Minn., under the trademark SCOTCH LITE.

Figure 9:
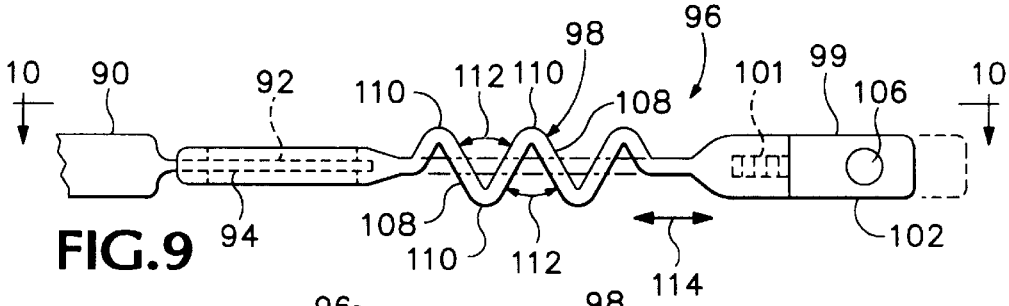
FIG. 9 is a view taken in the same direction as FIG. 4, showing a portion of a sling including a connector which is an alternative embodiment of the present invention.
Figure 10:
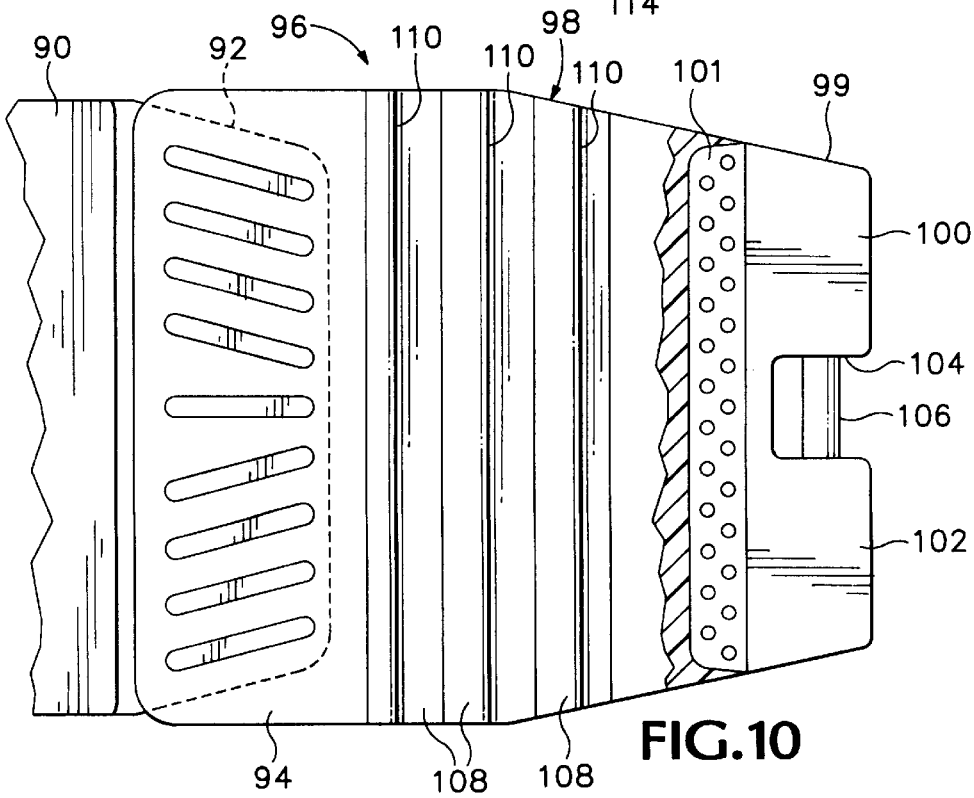
FIG. 10 is a partially cut-away view showing the portion of a sling body and the connector shown in FIG. 9, taken in the direction of the line 10—10.

Referring now also to FIGS. 9 and 10, a sling body member 90 that is an alternative embodiment of the invention may be similar to the sling body members 18 and 20 and includes an outer end portion 92 onto and surrounding which is molded a connector body portion 94 of an elastically extensible connector 96. An elastic central portion 98 of the connector 96 is formed of the same plastic material as the body portion 94 and is over-molded onto and thus securely attached to an outer or swivel portion 99 defining a pair of legs 100 and 102 separated by an opening 104 across which a swivel pin 106 extends. The outer or swivel portion 99 includes a perforated, rearwardly extending fin 101 to provide a strong mechanical connection to the central portion 98, and may be of the same material as the body 44 of the connector 32.

As may be seen most clearly in FIG. 9, the central portion 98 includes several short segments 108 interconnected along transversely extending linear junctions 110 oriented at included angles 112 with respect to each other as a zig-zag portion. In response to tension in such a connector 96, the angles 112 increase as the material of the connector 96 in linear junctions 110 and the segments 108 resiliently flexes and stretches so that the connector 96 can extend and contract in length as indicated by the double-pointed arrow 114. Depending on the elasticity of the plastic resin material used and the desired amount of potential elongation, the central portion 98 might be flat, without the zig-zag portion, as shown in phantom line in FIG. 9. As in the connector 32, the body portion 94 and central portion 98 may be of a suitable thermoplastic or reaction-setting plastic resin, chosen to provide a desired amount of potential elongation.

Figure 11:
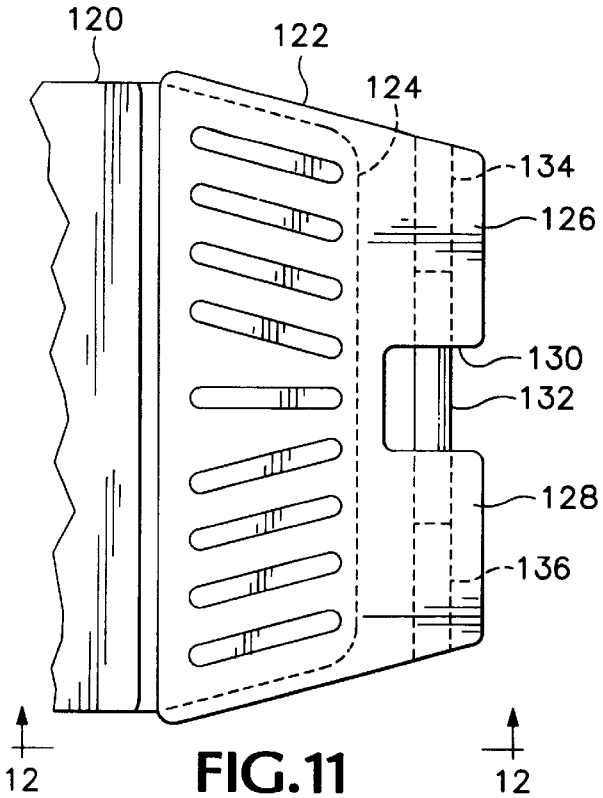
FIG. 11 is a view similar to that of FIG. 5, showing a portion of a sling body and a connector which is yet another alternative embodiment of the present invention.
Figure 12:
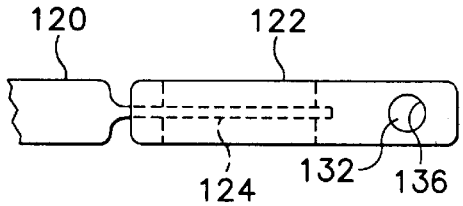
FIG. 12 is a view of the portion of a sling and connector shown in FIG. 11, taken in the direction of the line 12—12.

As may be seen in FIGS. 11 and 12, a further alternative embodiment of the present invention includes an elongate sling body member 120 that may be similar to the sling body member 18, for example, and has a connector 122 attached to an outer end portion 124 thereof similarly by being molded permanently into place on the outer end 124. The connector 122 includes a pair of legs 126 and 128 separated by an opening or space 130, across which a swivel pin 132 extends. Such a swivel pin 132 in such a connector 122 may be held in place in collinear bores 134 and 136 by friction provided by appropriate interference between the interior sizes of the bores 134 and 136 and the size of the swivel pin 132.

Figure 13:
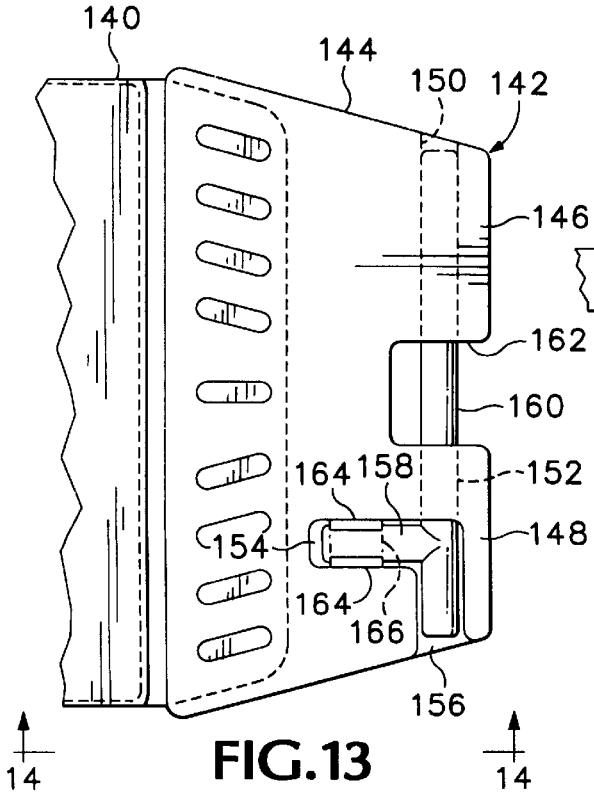
FIG. 13 is a view similar to that of FIG. 5, showing a portion of a sling and a connector which is a further alternative embodiment of the present invention.
Figure 14:
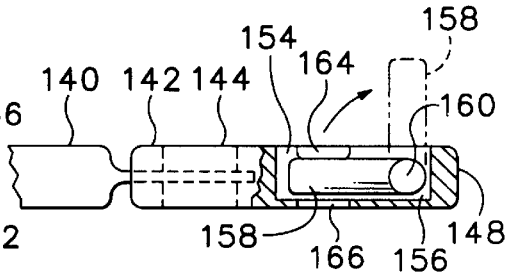
FIG. 14 is a view of the portion of a sling and connector shown in FIG. 13, taken in the direction of the line 14—14.
Figure 15:
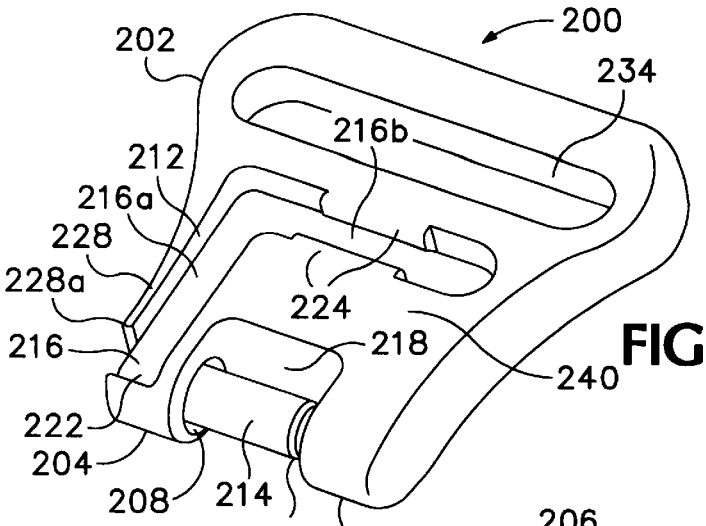
FIG. 15 is a perspective view of a connector which is a further alternative embodiment of the present invention.
Figure 16:
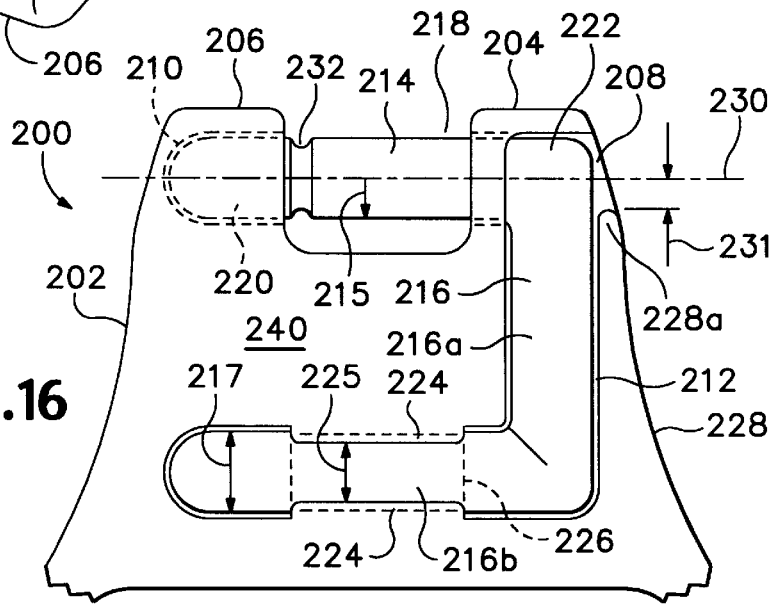
FIG. 16 is a view of a portion of the connector shown in FIG. 15.

A portion of a sling body 140 is shown in FIGS. 13 and 14, together with a connector 142 that is a further embodiment of the present invention. The connector 142 has a body 144 that is molded in place onto the end of the sling body 140 in a manner similar to that previously described with respect to the connector 32. The connector 142 has as pair of legs 146 and 148 defining respective collinear bores 150 and 152. The leg 146 also defines a channel or groove 154 aligned with the bore 150. Another channel or groove 156 is oriented at right angles to the groove 154 to receive an arm 158 extending at right angles from a special swivel pin 160 when the swivel pin 160 extends through the bores 150 and 152 and across a space 162 between the legs 146 and 148 to attach the connector 142 to a head of a swivel-receiving stud in the same manner described with respect to the connector 32 and as shown in FIG. 5.

Preferably, a pair of resiliently movable latch members 164, molded as part of the body 144, protrude into the groove 156, in a position interfering with movement of the arm 158, to prevent it from inadvertently swinging outward to a position (as shown in phantom line in FIG. 14) where the arm 158 is free to move along the groove 156 and allow the swivel pin 160 to be retracted from the bores 150 and 152. The latch members 164, because of their resiliency, can be pushed apart far enough by the arm 158 to permit the arm 158 to be pushed into place within the groove 154, where the latch members then keep the arm 158. Preferably, a hole 166 is provided in the opposite side of the body 144 and communicates with the bottom of the groove 154 to enable the arm 158 to be pushed outward from the groove 154 when it is desired to remove the swivel pin 160 from the bores 150 and 152.

FIGS. 15–18 show an alternative connector 200 having a body 202 that is preferably molded from a synthetic plastic material. It has been found that a material such as a glass-reinforced nylon 6 molding compound sold under the trade name CAPRON 8331GHI, available from Allied Signal Plastics of Redmond, Wash., will serve satisfactorily as the material of the connector. The connector 200 has first and second legs 204 and 206 defining respective collinear bores 208 and 210. The body 202 defines a groove 212 oriented at a right angle to the collinear bore 208. The groove 212 is in communication with the bore 208 of the first leg 204 and is oriented toward the top 240 of the body. A swivel pin 214 is made from mild steel which is cut and bent into shape. Alternatively, the swivel pin 214 may be made of any suitable material, whether metal or plastic. The swivel pin 214 has an arm 216 which is receivable into the groove 212 when the swivel pin 214 extends through the bores 208 and 210 and across a space 218 between the legs 204 and 206. The space 218 is wide enough to receive a swivel base, such as the head of a swivel receiving stud, so as to attach the connector 200 to the swivel stud in the same manner described with respect to the connector 32 and as shown in FIG. 5.

The swivel pin 214 is mounted between the first and second legs 204 and 206 and has a front end portion 220 and a rear end portion 222 receivable within respective ones of the pair of collinear bores 208 and 210. The swivel pin is rotatable with respect to the top 240 of the body 202 when the respective end portions 220 and 222 are located in the collinear bores 208 and 210. The arm 216 is receivable into the groove 212 when the end portions 220 and 222 are located in the collinear bores 208 and 210 by rotating the swivel pin 214 with respect to the body 202 to secure the arm 216 in the groove 212.

Preferably, a pair of resiliently movable or deformable latch members 224, molded as part of the body 202, protrude into the groove 212, in a position interfering with movement of the arm 216, to prevent arm 216 from inadvertently swinging outward. The arm 216 has a width 217 greater than the spacing 225 between the pair of resilient latch members 224 so that the latch members 224 secure the arm 216 within the groove 212. The latch members 224, because of their resiliency, can be pushed apart far enough by the arm 216, to permit the arm 216 to be pushed into place within the groove 212, where the latch members 224 then keep the arm 216. Preferably, the arm 216 has a first portion **216*a* extending away from the swivel pin 214 and a second portion 216*b* parallel to the swivel pin 214. The resilient latch. members 224 engage the second portion 216*b* of the arm 216**.

Figure 17:
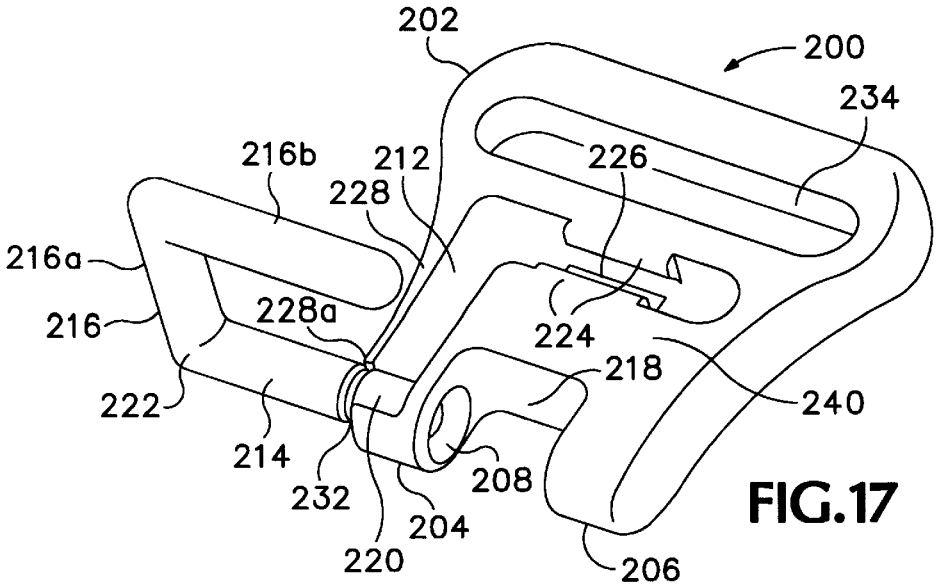
FIG. 17 is a perspective view of the connector shown in FIG. 15, showing engagement of the annular groove of the swivel pin by the projecting member.

In addition, a disengagement hole 226 is preferably provided in the opposite side of the body 202 and communicates with the bottom of the groove 212 to enable the arm 216 to be pushed outward from the groove 212 when it is desired to remove the swivel pin 214 from the bores 208 and 210. When the arm 216 is released from he latch members 224 (as shown in FIG. 17) the swivel in 214 is free to be inserted into or removed from the ores 208 and 210.

Figure 18:
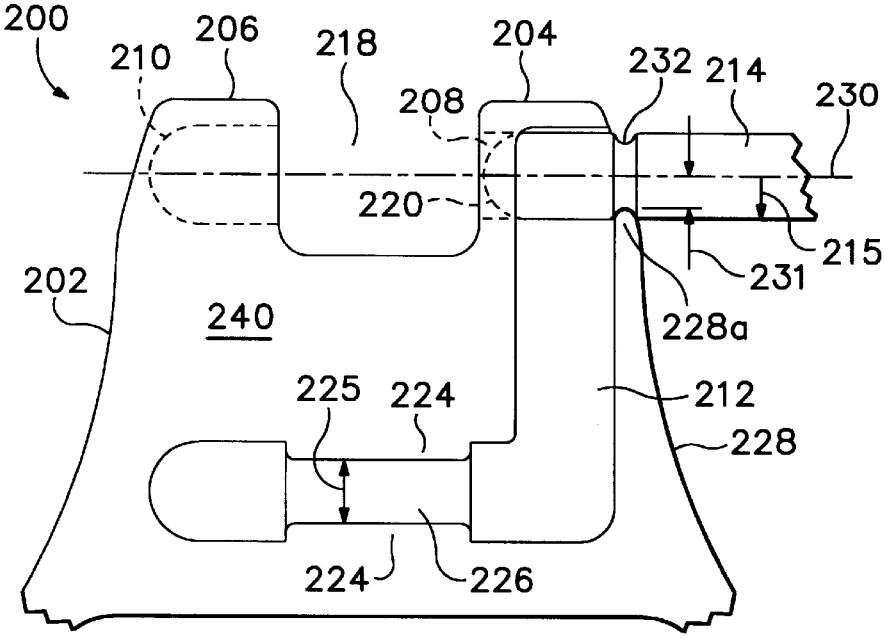
FIG. 18 is a partial view of the connector shown in FIG. 17.
Figure 19:
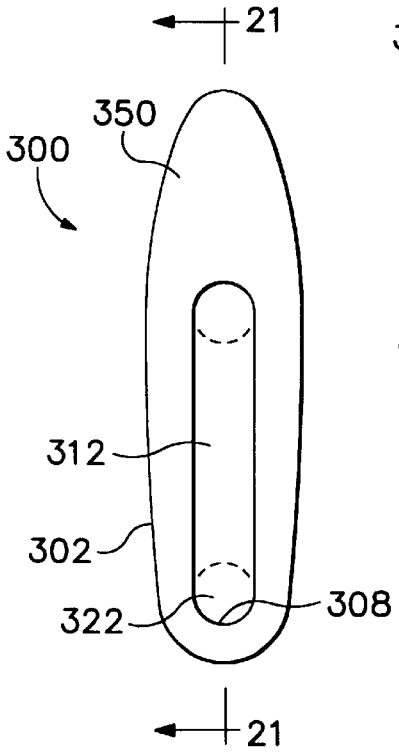
FIG. 19 is a side elevational view of a connector which is a further alternative embodiment of the present invention.
Figure 20:
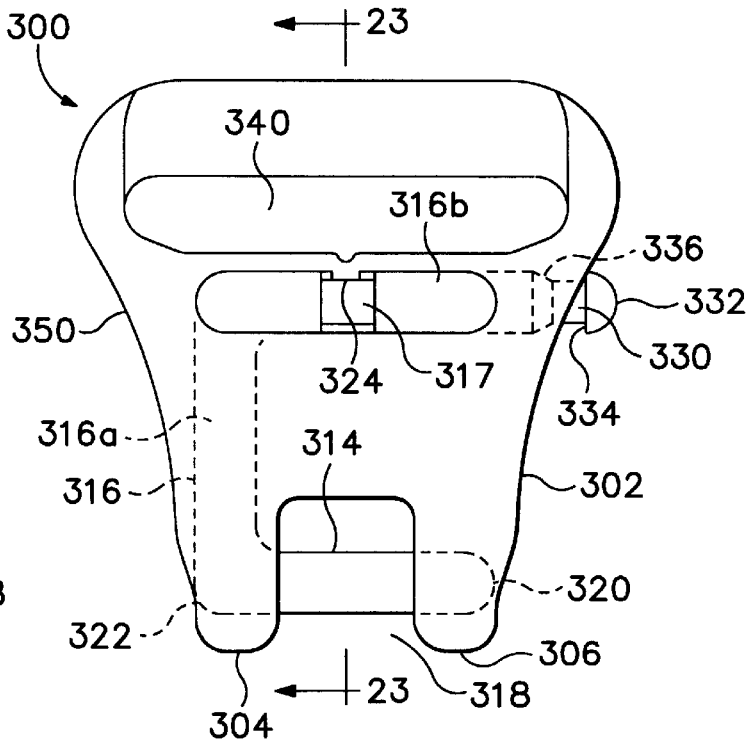
FIG. 20 is a plan view of the connector shown in FIG. 19.

Preferably, the body 202 further includes a resilient protruding latch member 228 adjacent to the first leg 204. Protruding latch member 228 is located at the side of the body 202 and acts as a wall to define a portion of the groove 212 and also has a tip 228*a*. The pair of collinear bores 208 and 210 define a central longitudinal axis 230. The distance 231 between the tip 228*a* and the longitudinal axis 230 is less than the radius 215 of the swivel pin 214. Accordingly, tip 228*a* is deflected resiliently by the swivel pin 214 when the swivel pin 214 is inserted into or removed from collinear bores 208 and 210. The swivel pin 214 further defines an annular groove 232 which extends around the swivel pin 214. As shown in FIG. 18, the tip 228*a* of the protruding latch member 228 matingly engages the annular groove 232 when the front end portion 220 of the swivel pin 214 is in the collinear bore 208 of the first leg 204. This prevents the swivel pin 214 from becoming detached from the body 202 when it is desired to release the connector 200 from, for example, a swivel stud.

In addition, body 202 preferably defines an opening 234 for receiving an end of a flexible strap. This allows the connector 200 to be connected to the flexible strap. Alternatively, the body 202 may be attached by molding the connector 200 to the flexible strap, or attaching the connector by other conventional means.

FIGS. 19–23 show an alternative connector 300 having a body 302 that is preferably molded from a synthetic plastic material. It has been found that a material such a glass-reinforced nylon 6 molding compound sold under the trade name Capron 8331GHI, available from Allied Signal Plastics from Redmond, Wash., will serve satisfactorily as the material of the connector 300. The connector 300 has first and second legs 304 and 306 defining respective collinear bores 308 and 310. The body 302 defines a groove 312 oriented at a right angle to the collinear bore 308. The groove 312 opens laterally to a side 350 of the body 302. The groove 312 is in communication with the bore 308 of the first leg 304. A swivel pin 314 is made from mild steel which is cut and bent into shape. Alternatively, the swivel pin 314 could be made from any other suitable material, whether metal or plastic. The swivel pin 314 has an arm 316 which is receivable into the groove 312 when the swivel pin 314 extends through the bores 308 and 310 and across a space 318 between the legs 304 and 306. The space 318 is wide enough to receive a swivel base, such as the head of a swivel receiving stud so as to attach the connector 300 to the swivel stud in the same manner described with respect to the connector 32 and as shown in FIG. 5.

The swivel pin 314 is mounted between the first and second legs 304 and 306 and has a front end portion 320 and a rear end portion 322 receivable within respective ones of the pair of collinear bores 308 and 310. The swivel pin 314 may be pushed into the body 302 so that the respective end portions 320 and 322 are located in the collinear bores 308 and 310. The body 302 secures the arm 316 in the groove 312.

Figure 23:
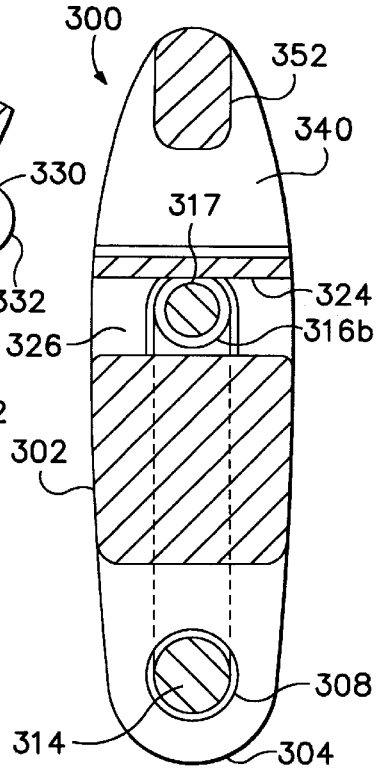
FIG. 23 is a section view taken along line 23—23 of the connector shown in FIG. 20.

Preferably, a resiliently moveable or deformable latch member 324, molded as a part of the body 302, protrudes into an opening 326, in a position interfering with the movement of the arm 316, to prevent arm 316 from inadvertently becoming disengaged from body 302. Preferably, the inside and outside corners of latch member 324 are right angles. As shown in FIG. 23, the latch member 324 extends substantially the entire width of the body 302. The arm 316 has an annular groove 317 so that the latch member 324 secures the arm 316 within the groove 312. The latch member 324, because of its resiliency, can be pushed away from the arm 316, to permit the arm 316 to be pushed into place within the groove 312, where the latch member 324 then keeps the arm 316. Preferably, the arm 316 has a first portion 316*a* extending away from the swivel pin 314 and a second portion 316*b* parallel to the swivel pin 314. The resilient latch member 324 engages the second portion 316*b* of the arm 316.

In addition, an arm disengagement hole 326 is preferably provided in the body 302 and communicates with the groove 312 to enable the arm 316 to be pushed outward from the groove 312 when it is desired to remove the swivel pin 314 from the bore 310. The disengagement hole 326 allows access to the latch member 324 so that latch member 324 may be disengaged from annular groove 317, thus allowing the swivel pin 314 to be freely removed from the bore 310.

Figure 22:
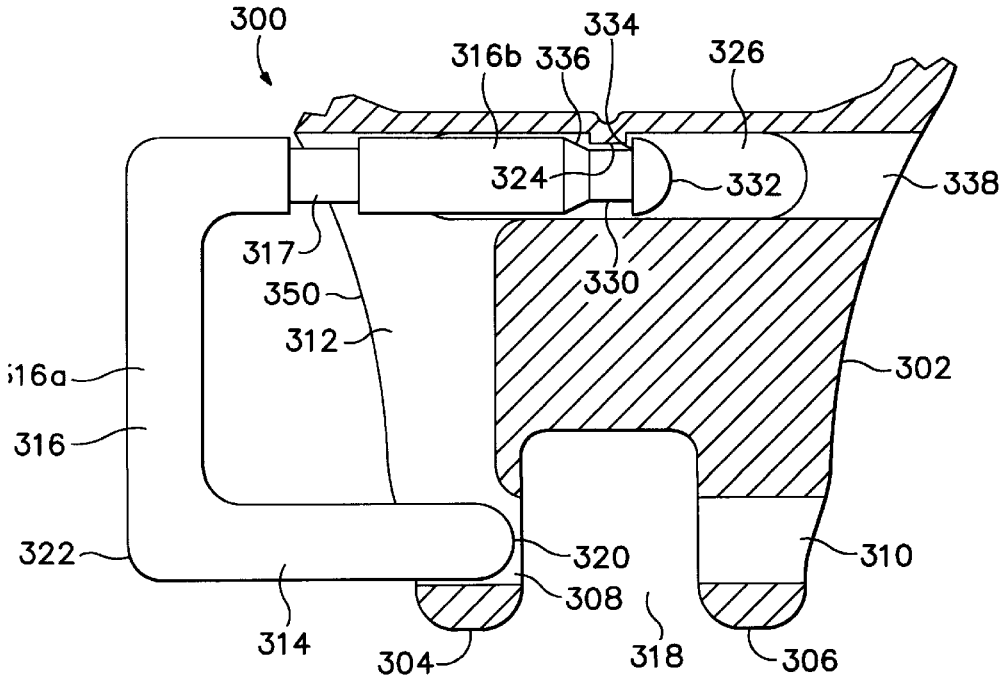
FIG. 22 is a view similar to FIG. 21, but showing partial insertion of the swivel pin.

Preferably, the arm 316 further includes another annular groove 330 adjacent to the end 332 of the arm 316. The annular groove 330 has a square edge 334 on one side adjacent to the rounded end 332, and a cam portion 336 on the other side. The body 302 has another bore 338 in communication with opening 326 for receiving the end 332 of arm 316. When the arm 316 is initially inserted into the opening 326, the rounded end 332 engages latch member 324 and pushes latch member 324 away from the arm 316. As shown in FIG. 22, as the arm 316 is inserted toward bore 338, the latch member 324 engages annular groove 330. The cam portion 336 allows the latch member 324 to be smoothly pushed away again from arm 316 as the swivel pin 314 is further inserted into the body 302. When arm 316*a* is located inside groove 312, latch member 324 engages annular groove 317 so as to retain swivel pin 314 in place. The annular groove 330 allows the swivel pin 314 to be removed from the bore 310 to allow receipt of a swivel stud, but latch member 324, by engaging the sharp edge 334 of the annular groove 330, retains the swivel pin 314 so that it does not detach from body 302.

Figure 21:
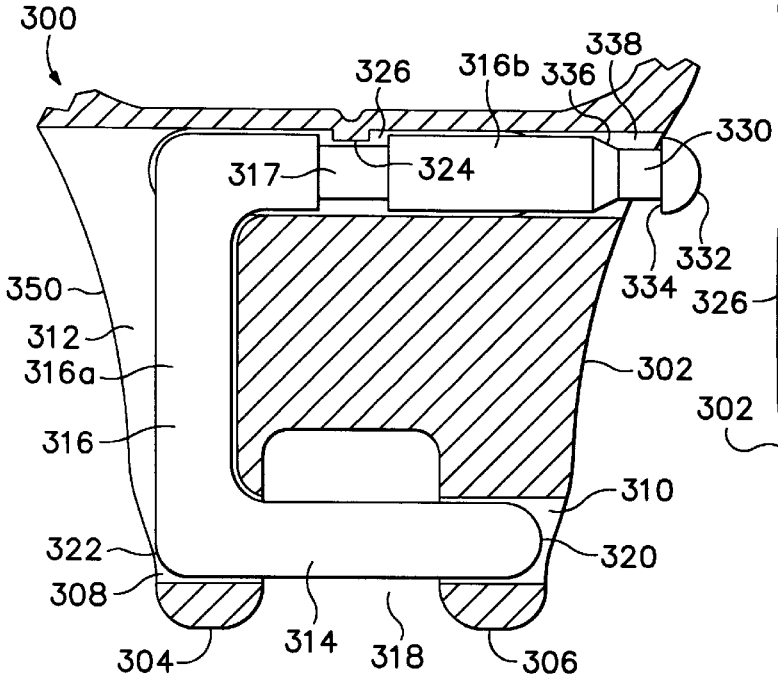
FIG. 21 is a section view taken along line 21—21 of a portion of the connector shown in FIG. 19, showing insertion of the swivel pin.

As shown in FIG. 21, the rounded end 332 extends beyond the bore 338 and outside of the body 302. This allows the rounded end 332 to be pressed toward the body 302 when the latch member 324 is disengaged from annular groove 317, thus facilitating disengagement of the swivel pin 314.

In addition, the body 302 preferably defines an opening 340 between bar 352 and latch member 324 for receiving an end of the flexible strap. This allows the connector 300 to be connected to the flexible strap. Alternatively, the body 302 may be attached by molding the connector 300 to the flexible strap, or attaching the connector by other conventional means.

While the connectors disclosed above have been disclosed in connection with attachment of a sling to a firearm, it will be understood that similar slings can be used for carrying equipment bags or other articles so long as the article to which the sling is to be attached is equipped with an attachment point including a bore corresponding with the previously-mentioned bore 64 in the head 56 of a sling mounting stud 24. In addition, while particular latching mechanisms have been disclosed, other restraining or latching mechanisms will be readily apparent to those skilled in the art to retain the swivel pin in place. For example, referring to the connector shown in FIGS. 19–23, the swivel pin 314 may be formed to have different indentations other than an annular groove which engages other latch members. Alternatively, the swivel pin 314 may have protrusions which engage indentations molded into the body 302.

The terms and expressions which have been employed in the foregoing specification are used therein as terms of description and not of limitation, and there is no intention, in the use of such terms and expressions, of excluding equivalents of the features shown and described or portions thereof, it being recognized that the scope of the invention is defined and limited only by the claims which follow.

What is claimed is:

1. A connector for use in fastening a flexible strap to a sling mounting member, the connector comprising:

(a) a body attachable to the flexible strap;

(b) first and second legs extending from said body, said legs being in fixed relation to each other and spaced apart from each other, said first and second legs each defining one of a pair of collinear bores, and said body defining a groove communicating with said bore of said first leg;

(c) a detachable swivel pin having an arm, said swivel pin being mountable to extend between said first and second legs and having front and rear end portions receivable within respective ones of said pair of collinear bores, and said arm being receivable within said groove; and (d) said body being capable of securing said arm within said groove.

2. The connector of claim 1 wherein said body further includes a resilient latch member capable of engaging said swivel pin.

3. The connector of claim 2 wherein said swivel pin defines an indentation, and said latch member matingly engages said indentation when said end portions of said swivel pin are located in said collinear bores.

4. The connector of claim 3 wherein said indentation is an annular groove extending around said arm.

5. The connector of claim 1 wherein said body is molded of a synthetic plastic material.

6. The connector of claim 1 further including a latch member capable of preventing said swivel pin from becoming detached from said body when one of said ends of said swivel pin is removed from said collinear bore of said second leg.

7. The connector of claim 6 wherein said swivel pin defines an indentation engageable with said latch member.

8. The connector of claim 1 wherein said body defines an opening for receiving therethrough an end of the flexible strap for attachment of said body to the flexible strap.

9. The connector of claim 1 wherein said arm has a first portion extending away from said swivel pin and a second portion parallel to said swivel pin.

10. The connector of claim 9 wherein said latch member engages said second portion of said arm member.

11. The connector of claim 1 wherein said body further defines an opening located proximate said latch member in communication with said groove of said body for receiving a portion of said arm.

12. A sling for carrying an object and suitable for attachment to a sling mounting member, comprising:

(a) an elongate flexible sling member having a pair of opposite ends;

(b) a connector having a body attached to said sling member, said connector having first and second legs extending from said body, said legs being spaced apart, said first and second legs each defining one of a pair of collinear bores, said body defining a groove communicating with said bore of said first leg;

(c) said connector further including a swivel pin having an arm, said swivel pin being mountable to extend between said first and second legs and having front and rear end portions receivable within respective ones of said pair of collinear bores, and said arm being receivable within said groove;

(d) said body capable securing said arm within said groove; and wherein said swivel pin further defines an indentation, and said latch member matingly engages said indentation when said end portions of said swivel sin are located in said collinear bores.

13. A connector for use in fastening a flexible strap to a sling mounting member, the connector comprising:

(a) a body attachable to the flexible strap;

(b) first and second legs extending from said body, said legs being spaced apart from each other, said first and second legs each defining one of a pair of collinear bores, and said body defining a groove communicating with said bore of said first leg;

(c) a swivel pin having an arm, said swivel pin being mountable to extend between said first and second legs and having front and rear end portions receivable within respective ones of said pair of collinear bores, and said arm being receivable within said groove;

(d) said body being capable of securing said arm within said groove; and wherein said body further includes a resilient latch member capable of engaging said swivel pin and wherein said swivel pin defines an indentation, and said latch member matingly engages said indentation when said end portions of said swivel pin are located in said collinear bores.

14. The connector of claim 13 wherein said indentation is an annular groove extending around said arm.

15. A connector for use in fastening a flexible strap to a sling mounting member, the connector comprising:

(a) a body attachable to the flexible strap;

(b) first and second legs extending from said body, said legs being spaced apart from each other, said first and second legs each defining one of a pair of collinear bores, and said body defining a groove communicating with said bore of said first leg;

(c) a swivel pin having an arm, said swivel pin being mountable to extend between said first and second legs and having front and rear end portions receivable within respective ones of said pair of collinear bores, and said arm being receivable within said groove;

(d) said body being capable of securing said arm within said groove; and wherein further including a latch member capable of preventing said swivel pin from becoming detached from said body when one of said ends of said swivel pin is removed from said collinear bore of said second leg.

16. The connector of claim 15 wherein said swivel pin defines an indentation engageable with said latch member.

* * * * *

UNITED STATES PATENT AND TRADEMARK OFFICE

CERTIFICATE OF CORRECTION

PATENT NO. : 6,178,600 B1
DATED : January 30, 2001
INVENTOR(S) : John M. French

It is certified that error appears in the above-identified patent and that said Letters Patent is hereby corrected as shown below:

Column 7,
Line 4, delete "he" and replace with -- the --
Line 5, delete "in" and replace with -- pin --

Column 10,
Line 18, delete "sin" and replace with -- pin --

Signed and Sealed this

Fifth Day of March, 2002

*Attest:*

*Attesting Officer*

JAMES E. ROGAN
*Director of the United States Patent and Trademark Office*